United States Patent [19]

Wallman

[11] 4,440,623

[45] Apr. 3, 1984

[54] RECYCLE CLASSIFIER FOR RETORTING OIL SHALE

[75] Inventor: P. Henrik Wallman, Berkeley, Calif.

[73] Assignee: Chevron Research Company, San Francisco, Calif.

[21] Appl. No.: 412,486

[22] Filed: Aug. 30, 1982

[51] Int. Cl.[3] ..... C10G 1/02; C10B 53/06; C10B 49/16

[52] U.S. Cl. ..... 208/11 R; 201/31

[58] Field of Search ..... 208/11 R, 8 R; 201/28, 201/29, 31, 32

[56] References Cited

U.S. PATENT DOCUMENTS

| | | | |
|---|---|---|---|
| 2,717,869 | 9/1955 | Turner | 208/11 R |
| 3,167,494 | 1/1965 | Crawford | 208/8 |
| 3,703,442 | 11/1972 | Rammler et al. | 201/12 |
| 3,855,070 | 12/1974 | Squires | 208/8 R X |
| 4,087,347 | 5/1978 | Langlois et al. | 208/11 R |
| 4,110,193 | 8/1978 | Gwyn et al. | 208/11 R |
| 4,133,739 | 1/1979 | Mitchell et al. | 208/11 R X |
| 4,141,794 | 2/1979 | Choi | 208/11 |
| 4,199,432 | 4/1980 | Tamm et al. | 208/11 R X |
| 4,230,557 | 10/1980 | Bertelsen et al. | 208/11 R X |
| 4,293,401 | 10/1981 | Sieg et al. | 208/11 R |
| 4,332,669 | 6/1982 | Spars et al. | 208/11 R |
| 4,336,126 | 6/1982 | Bertelsen | 208/11 R |
| 4,336,128 | 6/1982 | Tamm | 208/11 R |

OTHER PUBLICATIONS

"Shale Oil Retorting Process Promising", C & E News, Sep. 15, 1980.

*Primary Examiner*—Delbert E. Gantz
*Assistant Examiner*—Glenn Caldarola
*Attorney, Agent, or Firm*—D. A. Newell; S. R. LaPaglia; J. W. Ambrosius

[57] ABSTRACT

Heat transfer particles of fluidizable size are selected for recycling to the pyrolysis zone to broaden usable size range of oil shale feed. These recycle particles should all be of a fluidizable size and when mixed with the raw oil shale the total amount of fluidizable particles should comprise not less than about 60 weight percent of the particles in the mixture. This process is especially useful when the heat transfer material is recycled oil shale particles. The present invention is particularly advantageous when the oil shale is pyrolyzed in a vertical retorting vessel containing a fluidized bed above a packed bed of particles.

8 Claims, 1 Drawing Figure

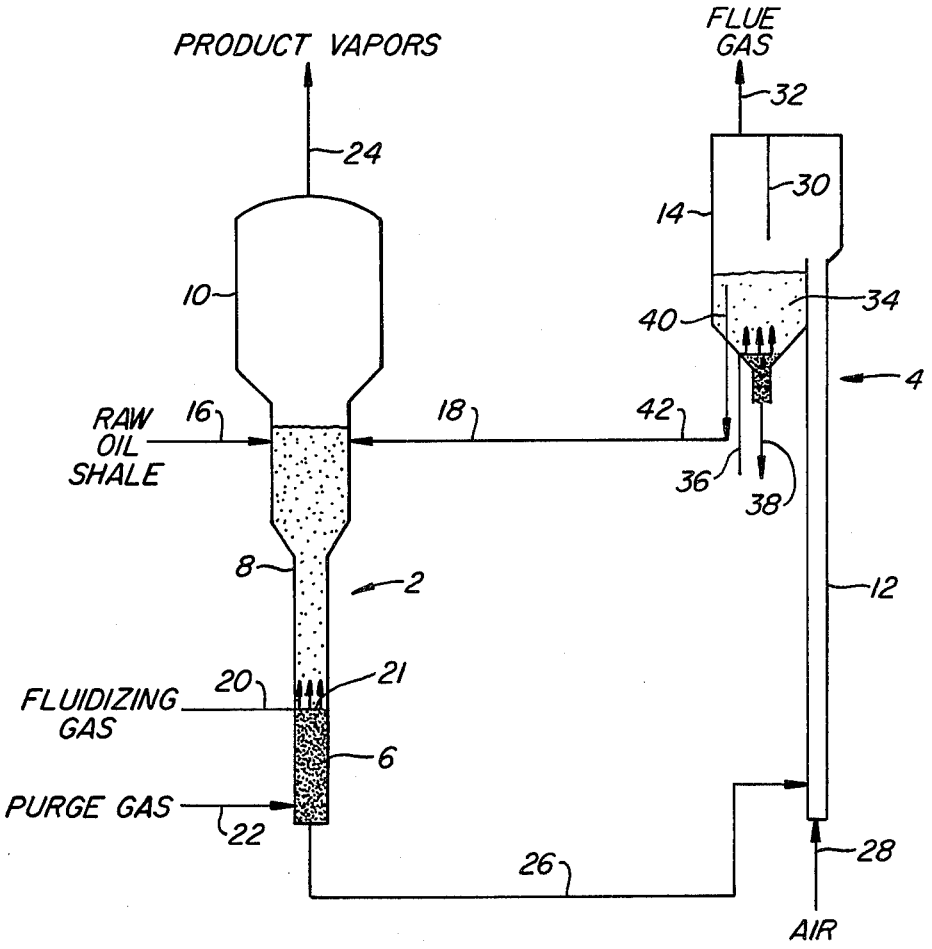
PRODUCT VAPORS
24
10
RAW OIL SHALE
16
18
8
2
FLUIDIZING GAS
20
21
6
PURGE GAS
22
26
FLUE GAS
32
30
14
34
40
4
42
36
38
12
28
AIR

RECYCLE CLASSIFIER FOR RETORTING OIL SHALE

BACKGROUND OF THE INVENTION

Oil shale is a naturally occurring material that contains a hydrocarbonaceous component referred to as "kerogen" which upon heating releases a hydrocarbonaceous vapor useful as a feedstock in petroleum processing. Both the true oil shales, i.e., those composed principally of silaceous sediments, and "false" oil shales found throughout the western United States (technically these latter materials are a marlstone) are fissile rock which upon crushing and grinding yield a variety of particle sizes ranging from a fine dust to large chunks. The inability of conventional grinding and crushing operations to produce a feed of uniform particle size, has led to downstream processing problems when a fluidized bed is used to pyrolyze the oil shale because such processes are able to tolerate only a limited range of particle sizes. In those processes using a recycled heat transfer material, the solids handling problem is compounded by the increased volume of material.

The use of a partially fluidized bed to control the passage of solids through the pyrolysis zone is one means for extending the ability of the retort to handle a wide range of particle sizes. An example of this type of bed is the staged turbulent bed described in U.S. Pat. No. 4,199,432. However, such improvements still require that the amount and maximum size of non-fluidizable particles be controlled within specified limits. Since the crushing and grinding step in most oil shale processes significantly increases in cost as the usable range of particle sizes narrows, it is desirable to design any process to be able to handle as broad a range of particle sizes as possible.

The present invention is concerned with a modified oil shale retorting process which increases the maximum particle size which can be tolerated in fluidized retorting systems using a particulate heat transfer material.

SUMMARY OF THE INVENTION

The present invention is directed to a process for pyrolyzing a particulate oil shale containing a substantial fraction of non-fluidizable particles which comprises:

(a) mixing the particulate oil shale with a hot fluidizable particulate heat transfer material in a ratio sufficient that at least 60 weight percent of the particles in the mixture are fluidizable;

(b) passing gas at a velocity above the minimum fluidization velocity of the fluidizable particles through the mixture of oil shale and heat transfer material, whereby particles of fluidizable size are fluidized;

(c) pyrolyzing the kerogen in the oil shale to release hydrocarbon vapors which are recovered as product vapors;

(d) recovering from the mixture of heat transfer material and pyrolyzed oil shale a fluidizable fraction of particles within a preselected size range;

(e) heating the fluidizable fraction to form hot heat transfer material;

(f) and mixing the hot heat transfer material of step (d) with additional particulate oil shale.

The present invention is particularly advantageous when the oil shale is pyrolyzed in a vertical retorting vessel containing a fluidized bed above a packed bed of particles. A critical limitation on the present invention is control of the particle sizes which are recycled as heat carrier material. These recycle particles should all be of a fluidizable size and when mixed with the raw oil shale the total amount of fluidizable particles should comprise not less than about 60 weight percent of the particles in the mixture. This process is especially useful when the heat transfer material is recycled oil shale particles.

In carrying out the present invention it is essential that a suitable means be selected for classifying and selecting particles of the desired size for recycle. One way this may be accomplished is when recycled burned shale serves as the heat transfer material and when a liftpipe combustor is incorporated into the process scheme. A disengaging section at the top of the liftpipe may be used to separate out the larger non-fluidizable particles. This is followed by a rough-cut cyclone for recovery of the recycle material followed by a standard cyclone to remove fines having a particle size too small to serve as effective heat transfer material. An alternate and preferred means for classifying the recycle shale uses a fluidized bed in which the fluidizable particles are drawn off the top of the fluidized bed. The coarser non-fluidizable particles fall to the bottom of the bed, while the fines are carried away as entrained particles by the fluidizing gas.

The other essential feature of the invention is that the non-fluidizable particles constitute no more than about 40 weight percent of the total particles present in the raw oil shale/recycle shale mixture. The amount of non-fluidizable particles in the raw shale feed should fall in the range of from about 50% to 100% by weight. If the fraction non-fluidizable material in the feed falls much below 50%, the process of this invention has no advantages over conventional fluidized bed processes. However, since crushing of the raw shale represents a major cost and this cost is inversely related to particle size, the invention significantly lowers the cost of feed preparation.

Preferably, the fluidized bed uses a moving packed bed of the oil shale-heat carrier mixture below the upper fluidized bed. This moving packed bed provides sufficient residence time for the kerogen pyrolysis.

Thus, a principal advantage of the present process is that the raw oil shale entering the retort may contain significantly more particles of non-fluidizable size and have larger maximum diameters than could heretofore be tolerated by known fluidized retorting processes.

BRIEF DESCRIPTION OF THE DRAWING

The FIGURE is a schematic representation of one embodiment of the process of the invention.

DETAILED DESCRIPTION OF THE INVENTION

The invention may be most easily understood by reference to the FIGURE. Shown is a retorting vessel 2 and a combustor 4. The retorting vessel is divided into three zones. The lower zone 6 contains a moving packed bed of particles. The intermediate zone 8 contains a fluidized bed of particles, and the upper zone 10 serves as a disengaging area. The combustor 4 is divided into a liftpipe 12 and a collection and classification chamber 14.

In operation crushed raw oil shale is introduced into the top of the intermediate zone 8 of the retorting vessel 2 via the raw shale inlet 16. In the intermediate zone the raw oil shale is mixed with recycle burned shale entering via recycle inlet conduit 18. In the intermediate zone particles of suitable size are fluidized by evolving hydrocarbon product vapors augmented by a fluidizing gas introduced into the bottom of the intermediate zone via fluidizing gas inlet 20. Particles too large to fluidize fall downward through the fluidized bed into lower zone 6 containing a moving packed bed of particles. Gas distributor 21 has sufficient open area to allow even particles of fluidizable size to pass downward together with the coarser non-fluidizable material. A purge gas is introduced into the bottom of the packed bed via inlet 22 to carry the pyrolyzed product vapors, i.e., shale oil vapors, out of the lower zone. Particles of raw oil shale are heated in the fluidized bed to pyrolysis temperature and are pyrolyzed to completion in the moving packed bed. Bed level is controlled by adjusting the draw rate of the shale-heat carrier mixture from the bottom of the packed-bed section.

The shale oil vapors, fluidizing gas, and purge gas along with any entrained fines pass out of the rotorting vessel by means of gas outlet 24. The upper zone 10 serves as a disengaging area to prevent all but the finest particles from being carried out of the retort with the vapors. The majority of the particles which is composed of a mixture of heat-carrier material and pyrolyzed oil shale pass out of the retort to the combustor 4 via conduit 26.

In the liftpipe 12 of the combustor 4, the mixture of pyrolyzed shale and heat-carrier material is entrained in a stream of oxidizing gas, generally air, entering via inlet 28. In the liftpipe the carbonaceous residue that remains in the pyrolyzed shale particles following decomposition of the kerogen is ignited and burned to heat the particles in the liftpipe to an elevated temperature. The hot shale particles leave the top of the liftpipe and enter the collection and classification chamber 14. A partition baffle 30 prevents the hot shale particles from directly entering the flue gas outlet 32. Instead the particles are directed into a fluidized bed 34 fluidized by a gas, generally secondary air, entering via gas conduit 36. Shale particles of too large a size to serve as recycle heat-carrier material are removed by means of coarse shale outlet 38 at the bottom of the collection and classification chamber. Particles too fine for recycling are carried out as entrained particles with the flue gas via outlet 32. Particles in the desired size range are drawn off the top of the fluidized bed by means of an overflow well 40. The hot recycle shale collected from the fluidized bed pass via conduit 42 to recycle inlet conduit 18. Excess recycle shale is removed from the system together with oversized material by means of outlet 38. The particle size range of the recycle material depends mainly on the selected fluidization gas velocity in fluidized bed 34. A higher gas velocity shifts the particle size distribution of the recycle toward larger particle sizes.

The invention is principally intended for use with processes in which oil shale is recycled as heat transfer material. However, the process may also be employed when other heat transfer particles of fluidizable size are used. Such heat transfer particles include such materials as ceramic compositions, sand, alumina, steel or the like. In some retorting processes these materials are used exclusively as the heat transfer particles. Most preferably these materials serve as supplemental heat transfer material, i.e., they merely supplement the recycle shale. In a process such as described above the heat transfer material is heated to a temperature of about 1300° F. in the combustor. When mixed with the raw shale in the retort, the equilibrium temperature of the mixture, i.e., raw shale and heat transfer material, will be about 950° F. This is sufficient to decompose the kerogen and release the desired shale oil vapors with a total shale residence time of a few minutes in the retort vessel.

Decomposition of the kerogen in the oil shale occurs at temperatures in excess of about 400° F. (200° C.). For practical retorting processes the pyrolyzing temperatures are usually much higher, generally falling in the range of from about 850° F. to about 1000° F. At temperatures above about 1000° F. undesirable thermal cracking of the shale oil vapor takes place resulting in a significant yield loss due to the associated coke formation. The temperature to which the recycle material is heated prior to introduction into the retort and prior to mixture with the raw oil shale depends upon a number of factors such as the ratio of heat carrier to raw oil shale, the grade of the raw oil shale, the coke yield in the retort and the efficiency of the combustion. Generally, the temperature of heat carrier particles is in the range of from about about 1100° F. to about 1500° F. at the time it enters the retorting vessel. In carrying out the present invention a recycle ratio in the range of about 1 to about 5 (recycle/raw shale) is usually employed with a ratio in the range of from about 2 to 3 being preferred.

As noted above, it is essential that the heat transfer particles all fall within the fluidizable size range. Thus, an efficient means for classifying and recovering particles within the desired size range is critical for carrying out the invention. The exact cut size of the particles will vary with the details of the process. Thus an optimal size range for recycle material cannot be stated generally, but is dependent on the fluidization conditions prevailing in the retort. In determining the optimal size range of the particles such factors must be considered as the superficial velocity of the fluidization gas, the density of the heat-carrier material and the increase in gas velocity due to product vapor evolution. In a process such as described above in reference to the FIGURE, assuming a superficial gas velocity for the injected fluidization gas of about 1 foot/sec., a good cut size for the recycle material would be between 16 and 200 mesh (Tyler Standard Sieve).

The superficial velocity at which a given particle size becomes fluidized in a bed of similar particles is termed the minimum fluidization velocity. As used herein, fluidizable particles are distinguished from both non-fluidizable particles and entrained particles. Non-fluidizable particles refer to particles of too large a size to fluidize at prevailing bed conditions. Non-fluidized particles thus sink to the bottom of the fluidized bed forming a packed bed at the bottom. Entrained particles are particles which are transported by the gas stream principally in a single direction as opposed to the random motion characterizing fluidization. Usually the superficial velocity of the injected fluidization gas passing through the mixture of oil shale and heat transfer material is in the range of from about 0.1 ft/sec. and about 2 ft./sec.

In carrying out the process of the present invention, the gas introduced into the retorting zone for fluidizing the particles and stripping the product vapors should be an inert gas, e.g. a non-oxidizing gas, to minimize product loss. Since significant amounts of hydrocarbon vapors are produced during pyrolysis of the oil shale, these vapors may also serve as fluidizing gas. If required to supplement the product vapors, a supplemental inert gas such as steam, recycled retort gas, natural gas, or the like, may be used. Such gases are also suitable for use as a purge gas, if needed, in the optional packed bed below the fluidized bed.

What is claimed is:

1. A process for pyrolyzing a particulate oil shale containing at least 50 weight percent particles of non-fluidizable size which comprises:

(a) mixing in the upper part of a retorting zone the particulate oil shale with a hot fluidizable particulate heat transfer material in a ratio sufficient that at least 60 weight percent of the particles in the mixture are fluidizable;

(b) passing an inert gas upwardly in the upper part of the retorting zone at a velocity above the minimum fluidization velocity of the fluidizable particles through the mixture of oil shale and heat transfer material, whereby a fluidized zone composed of particles of fluidizable size is established in the upper part of the retorting zone;

(c) collecting in the lower part of the retorting zone below the fluidized zone particles of both fluidizable and non-fluidizable size which have passed through said fluidized zone, whereby a packed bed of solids is established below said fluidized zone;

(d) pyrolyzing in the retorting zone the kerogen in the oil shale to release hydrocarbon vapors which are recovered as product vapors;

(e) introducing a purge gas into said packed bed to carry hydrocarbon vapors out of lower part of said retorting zone;

(f) withdrawing solids comprising a mixture of heat transfer material and pyrolyzed oil shale from the bottom of the retorting zone;

(g) recovering from the mixture of heat transfer material and pyrolyzed oil shale a fluidizable fraction of particles within a preselected size range;

(h) heating the fluidizable fraction of step (f) to form hot heat transfer material;

(i) and recycling the hot heat transfer material of step (e) back to the retorting zone for admixture with additional particulate oil shale.

2. The process of claim 1 wherein the superficial velocity of the injected fluidization gas passing through the mixture of oil shale and heat transfer material in the range of from about 0.1 ft./sec. to about 2 ft./sec.

3. The process of claim 1 wherein at least part of the heat for heating the heat transfer material is furnished by burning the carbonaceous residue that is in the pyrolyzed oil shale.

4. The process of claim 3 wherein the inorganic residue that remains after burning of the carbonaceous residue in the pyrolyzed oil shale is used as heat transfer material.

5. The process of claim 1 wherein the fluidizable fraction is recovered from a fluidized bed.

6. The process of claim 1 wherein the recycle ratio is in the range of from about 1 to about 5 recycle to raw shale.

7. The process of claim 6 wherein the recycle ratio is in the range of from about 2 to about 3 recycle to raw shale.

8. The process of claim 1 wherein the gas used to fluidize the particles contains an inert gas selected from the group consisting of steam, recycled retort gas and natural gas.

* * * * *